US008267329B2

(12) United States Patent
Kobayashi et al.

(10) Patent No.: US 8,267,329 B2
(45) Date of Patent: Sep. 18, 2012

(54) EXPANSION VALVE WITH NOISE REDUCTION MEANS

(75) Inventors: Kazuto Kobayashi, Tokyo (JP); Takashi Mogi, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 595 days.

(21) Appl. No.: 12/009,550

(22) Filed: Jan. 18, 2008

(65) Prior Publication Data

US 2008/0185452 A1 Aug. 7, 2008

(30) Foreign Application Priority Data

Jan. 26, 2007 (JP) ..... 2007-015814
Jan. 26, 2007 (JP) ..... 2007-015815

(51) Int. Cl.
*F25B 41/04* (2006.01)
*F25B 41/06* (2006.01)
*G05D 23/12* (2006.01)

(52) U.S. Cl. ..... 236/92 B; 236/93 A; 236/93 R

(58) Field of Classification Search ..... 236/92 B, 236/93 A, 93 R, 99 J, 100; 261/337; 251/337
See application file for complete search history.

(56) References Cited

U.S. PATENT DOCUMENTS 5,597,117 A * 1/1997 Watanabe et al. ..... 236/92 B
6,427,243 B2 * 8/2002 Kobayashi et al. ..... 236/92 B
6,560,982 B2 * 5/2003 Kobayashi et al. ..... 62/225
6,837,442 B2 * 1/2005 Kobayashi et al. ..... 236/92 B
2002/0109012 A1 * 8/2002 Watanabe et al. ..... 236/92 B
2002/0185621 A1 * 12/2002 Kobayashi et al. ..... 251/61.3
2005/0120741 A1 * 6/2005 Nanbu et al. ..... 62/527
2005/0178152 A1 * 8/2005 Kobayashi et al. ..... 62/527
2009/0230602 A1 * 9/2009 Takamura et al. ..... 267/174

FOREIGN PATENT DOCUMENTS

EP 1179716 7/2001
EP 1275916 A2 * 1/2003
EP 1598581 4/2005
JP 2002-054861 2/2002
JP 2002-318037 10/2002
JP 2003-307372 10/2003
JP 2005-226846 8/2005

* cited by examiner

*Primary Examiner* — Cheryl J Tyler
*Assistant Examiner* — Paolo Gonzalez
(74) *Attorney, Agent, or Firm* — Fildes & Outland, P.C.

(57) ABSTRACT

In an expansion valve, in a first passage through which a high pressure liquid refrigerant flows, an inlet port includes a large diameter passage portion formed from one side surface to the other side surface of a valve body, and a small diameter passage portion that provides communication between the large diameter passage portion on the bottom end thereof and a valve chamber. A coil spring provided in the valve chamber biases a valve member toward a valve hole. An O ring that seals between a plug that supports a lower end of the coil spring and the valve body is located below the small diameter passage portion and placed on the opposite side of the bottom end of the large diameter passage. Thus, the plug that closes an opening of the valve chamber can be mounted to an upper position, thereby reducing a vertical size of the valve body to further reduce a size of the valve body, and reducing an amount of use of metal materials for the valve body to reduce weight and cost.

3 Claims, 4 Drawing Sheets

EXPANSION VALVE WITH NOISE REDUCTION MEANS

The present application is based on and claims priority of Japanese patent applications No. 2007-015814 filed on Jan. 26, 2007 and No. 2007-015815 filed on Jan. 26, 2007, the entire contents of which are hereby incorporated by reference.

BACKGROUND OF THE INVENTION

1. Field of the Invention

The present invention relates to an expansion valve including a temperature sensing mechanism used in a refrigeration cycle.

2. Description of the Related Art

In a refrigeration cycle used in air conditioning devices or the like provided in automobiles, a temperature expansion valve including a temperature sensing mechanism that adjusts an amount of passing refrigerant according to temperature has been used for saving an installation space and wiring.

FIG. 4 is a sectional view of an example of a conventional expansion valve including a temperature sensing mechanism. In a valve body 30, a first passage 32 and a second passage 34 are formed vertically spaced apart from each other, the first passage 32 being a passage for a high pressure liquid refrigerant having condensed by a condenser 5 and passed through a receiver 6, and the second passage 34 being a passage through which a gas phase refrigerant supplied from a refrigerant outlet of an evaporator 8 to a refrigerant inlet of a compressor 4 flows. Reference numeral 11 denotes piping.

The first passage 32 includes an inlet port 321 through which the liquid refrigerant is introduced, a valve chamber 35 communicating with the inlet port 321, a valve hole 32*a* provided in the valve chamber 35, and an outlet port 322 through which the refrigerant expanded in the valve hole 32*a* is discharged to the outside. A valve seat is formed at an inlet of the valve hole 32*a*, and a valve member 32*b* is placed to face the valve seat. The valve member 32*b* is biased toward the valve seat by a compression coil spring 32*c*. A lower end of the valve chamber 35 opens in a bottom surface of the valve body 30, and the opening is sealed by a plug 37 screwed into the valve body 30.

To an upper end of the valve body 30, a valve member driving device 36 for driving the valve member 32*b* is mounted. The valve member driving device 36 includes a pressure operating housing 36*d* having an inner space partitioned by a diaphragm 36*a* into two upper and lower pressure operating chambers 36*b* and 36*c*. The lower pressure operating chamber 36*c* in the pressure operating housing 36*d* communicates with the second passage 34 via a pressure equalizing hole 36*e* formed concentrically with the centerline of the valve hole 32*a*. A pressure of the gas phase refrigerant in the second passage 34 is applied to the lower pressure operating chamber 36*c* via the pressure equalizing hole 36*e*.

In the pressure equalizing hole 36*e*, a valve member driving rod 36*f* extending from a lower surface of the diaphragm 36*a* to the valve hole 32*a* formed with respect to the first passage 32 is placed concentrically with the pressure equalizing hole 36*e*. The valve member driving rod 36*f* is vertically slidably guided by a slide guide hole provided in a partition portion between the first passage 32 and the second passage 34 in the valve body 30, and a lower end of the valve member driving rod 36*f* abuts against the valve member 32*b*. To the partition portion, a seal member 36*g* is mounted that prevents leakage of the refrigerant between the first passage 32 and the second passage 34.

The upper pressure operating chamber 36*b* in the pressure operating housing 36*d* is filled with a known diaphragm driving fluid, to which heat of the gas phase refrigerant flowing through the second passage 34 is transferred via the valve member driving rod 36*f* located in the second passage 34 and the pressure equalizing hole 36*e* and the diaphragm 36*a*. The diaphragm driving fluid in the upper pressure operating chamber 36*b* is gasified by the transferred heat, and a pressure of the gas is applied to an upper surface of the diaphragm 36*a*. The diaphragm 36*a* is vertically displaced according to differences between the pressure of the diaphragm driving gas applied to the upper surface of the diaphragm 36*a* and the pressure applied to the lower surface thereof. The vertical displacement of the central portion of the diaphragm 36*a* is transmitted to the valve member 32*b* via the valve member driving rod 36*f*, and the valve member 32*b* is brought close to and apart from the valve seat at the valve hole 32*a*. This controls a flow rate of the refrigerant flowing toward the evaporator 8. Japanese Patent Laid-Open Publication No. 2002-054861 discloses an expansion valve having a similar structure, in which a heat transfer delay member is housed in a valve member driving rod to prevent hunting of a valve member.

SUMMARY OF THE INVENTION

Ensuring an installation space for the expansion valve as described above has become more difficult with reduction in size of recent air conditioning devices. Also, materials for the valve body have become more expensive. Thus, a further reduction in size of the expansion valve has been desired.

In the expansion valve as described above, the refrigerant flowing through the first passage 32 sometimes entrains bubbles, and noise occurs when the bubbles flow into the valve chamber 35 with the refrigerant and break. It is proven that the noise becomes louder for larger bubble diameters.

The present invention has an object to provide an expansion valve in which a size of a valve body is further reduced to reduce an amount of use of metal materials for the valve body, thereby reducing weight and cost.

The present invention has another object to provide an expansion valve in which bubbles in a liquid refrigerant that may produce refrigerant passing noise are reduced to a finer size to reduce the refrigerant passing noise.

To solve the above described problems, an expansion valve according to the present invention includes: a valve body; an inlet port formed in the valve body and through which a high pressure liquid refrigerant is introduced; a valve chamber communicating with the inlet port and having a lower end opening in a bottom surface of the valve body; a valve hole provided in the valve chamber; an outlet port formed in the valve body and through which the refrigerant expanded in the valve hole is discharged to the outside; a valve member that is brought close to and apart from a valve seat provided at an inlet of the valve hole and opens and closes the valve hole; a coil spring provided in the valve chamber for biasing the valve member toward the valve hole; a plug that is inserted and mounted into the lower end of the valve chamber to support a lower end of the coil spring, and closes the opening of the valve chamber; and an O ring that is provided between an outer peripheral portion of the plug and an inner peripheral portion of the valve chamber and prevents leakage of the refrigerant in the valve chamber through the opening to the outside, wherein the inlet port includes a large diameter passage portion formed from one side surface to the other side surface of the valve body, and a small diameter passage portion that provides communication between the large diameter passage portion on the bottom end thereof and the valve chamber, and the O ring is located below the small diameter passage portion and placed on the opposite side of a bottom end of the large diameter passage portion.

Also, an expansion valve according to the present invention includes: an inlet port through which a high pressure liquid refrigerant is introduced; a valve chamber communicating with the inlet port; a valve hole provided in the valve chamber; an outlet port through which the refrigerant expanded in the valve hole is discharged to the outside; a valve member that is brought close to and apart from a valve seat provided at an inlet of the valve hole and opens and closes the valve hole; and a coil spring provided in the valve chamber for biasing the valve member toward the valve hole, wherein a size of a space between adjacent coil wires of the coil spring is set so as to reduce bubbles entrained in the liquid refrigerant to a finer size.

According to the present invention, the coil spring as biasing means for biasing the valve member toward the valve seat is used to reduce the bubbles in the refrigerant to a finer size. This eliminates the need for providing separate means for reducing bubbles to a finer size, and can reduce refrigerant passing noise without an increase in the number of components.

In the expansion valve, the size of the space between the coil wires of the coil spring in an expanding and contracting direction of the coil spring is preferably 0.54 mm or smaller in a valve closing state where the valve member abuts against the valve seat.

The expansion valve according to the present invention is configured as described above, and thus the plug can be mounted to an upper position as compared with the above described conventional one, thereby reducing a vertical size of the valve body and reducing cost.

The expansion valve according to the present invention is configured as described above, and thus the bubbles in the liquid refrigerant are reduced to a finer size by the coil wires of the coil spring when the liquid refrigerant passes through the coil spring, thereby reducing refrigerant passing noise even if the bubbles are broken, without an increase in the number of components.

DETAILED DESCRIPTION OF THE PREFERRED EMBODIMENTS

Figure 1A:
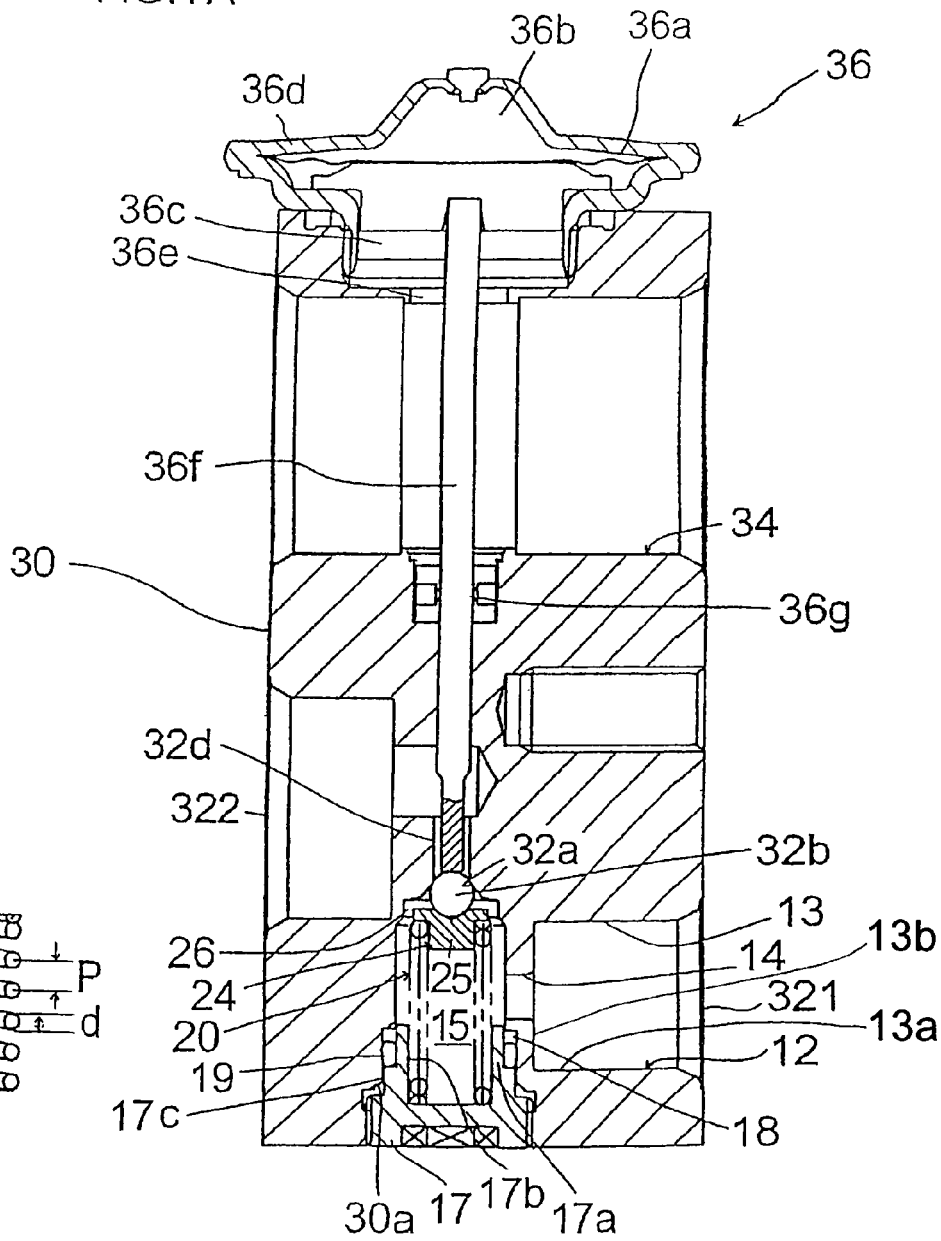
FIG. 1 shows an embodiment of an expansion valve according to the present invention.
Figure 1B:
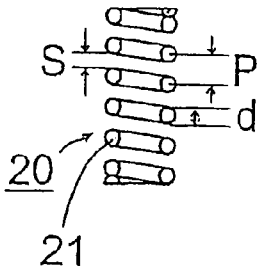
Figure 4:
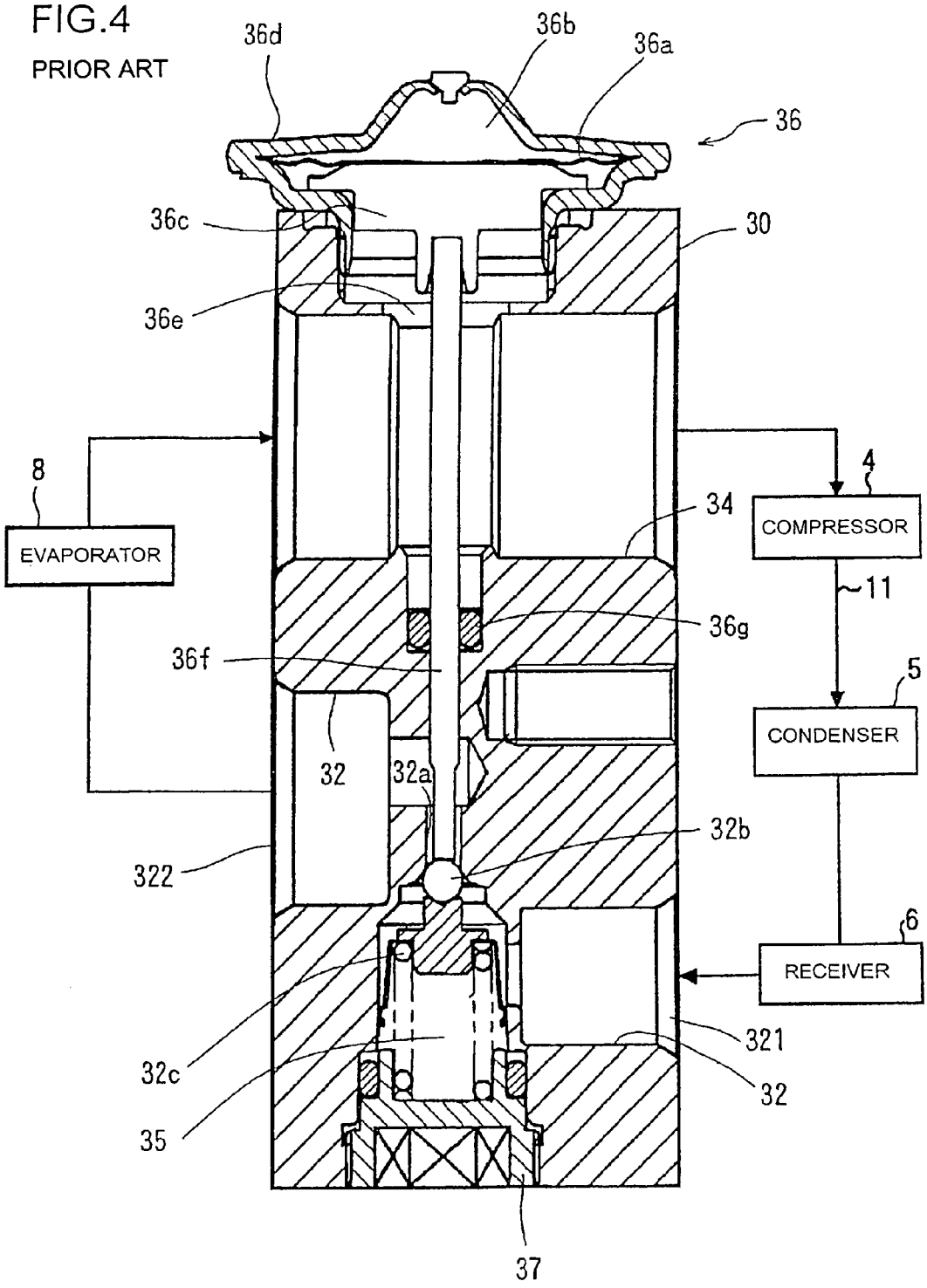
FIG.4 PRIOR ART
FIG. 4 is a sectional view of an example of a conventional expansion valve including a temperature sensing mechanism.

Now, an embodiment of an expansion valve according to the present invention will be described with reference to the accompanying drawings. FIG. 1(*a*) is a vertical sectional view of the embodiment of the expansion valve according to the present invention, and FIG. 1(*b*) shows an example of a coil spring mounted to a valve chamber. In the embodiment, components and sites having the same functions as those in a conventional expansion valve in FIG. 4 are denoted by the same reference numerals as in FIG. 4, and repetitive descriptions thereof will be omitted.

In the expansion valve in FIG. 1(*a*), an inlet port 321 includes a large diameter passage portion 13 connected to piping communicating with a receiver, and a small diameter passage portion 14 communicating with, at one end, a valve chamber 15 and, at the other end, the large diameter passage portion 13 on a bottom end 13*a* thereof. The large diameter passage portion 13 and the small diameter passage portion 14 are coaxially formed. The large diameter passage portion 13 includes a vertical end face 13*b* that is defined by a surface between the large diameter passage portion 13 and the small diameter passage portion 14. A valve hole 32*a* formed above the valve chamber 15 communicates with a through hole 32*d* through which a valve member driving rod 36*f* can pass with a gap.

A plug 17 that closes the valve chamber 15 includes a cylindrical spring support 17*a* on the side of the valve chamber 15. The spring support 17*a* has an inner surface that is a straight inner cylindrical surface 17*b*, and an outer surface that is an outer cylindrical surface 17*c* having a diameter decreasing toward an upper end with multiple steps. In conformity to the outer cylindrical surface 17*c*, a plug mounting portion 30*a* is formed at a lower end of the valve chamber 15, and when the plug 17 is screwed into the plug mounting portion 30*a*, a male thread of the plug 17 and a female thread of the plug mounting portion 30*a* are threaded to each other to secure the plug 17 into the valve body 30.

The inner cylindrical surface 17*b* of the spring support 17*a* of the plug 17 radially limits a coil spring 20 described later that biases a valve member 32*b* in a valve closing direction to prevent the inclination of the coil spring 20. With the plug 17 being screwed into the back, an annular space 18 is formed between the plug mounting portion 30*a* and the outer cylindrical surface 17*c*. The annular space 18 is located in a position on the opposite side of the bottom end of the large diameter passage portion 13 in a first passage 12 and below the small diameter passage portion 14. An O ring 19 is mounted in the annular space 18 and prevents leakage of a refrigerant in the valve chamber 15 to the outside through a space between the valve chamber 15 and the plug 17.

As shown in FIG. 1(*b*), in the coil spring 20, a space S between adjacent coil wires, the width of the space S calculated by subtracting a wire diameter d from a pitch (a distance between the centers of adjacent coil wires 21 and 21) P is set to be small so as to maintain the function of the coil spring 20 and reduce bubbles in the refrigerant to a finer size. For example, in a valve closing state of the valve member 32*b* (a state with the longest coil spring 20), the space S is set to 0.54 mm or smaller. The refrigerant having entered the first passage 12 flows through the large diameter passage portion 13, the small diameter passage portion 14, the valve chamber 15, and the through hole 32*d* in the valve opening state of the valve member 32*b*. Bubbles in the refrigerant having a diameter larger than the space S are reduced by the coil wires 21 to a finer size having a diameter equal to or smaller than the space S when passing through the coil spring 20 in the valve chamber 15. Thus, even if the bubbles reduced to a finer size are broken, reduced noise is produced at the time, thereby reducing refrigerant passing noise of the expansion valve.

The valve member 32*b* is supported by a support member 24 having a recessed support surface on an upper side. Below the support member 24, a short shaft 25 is inserted into the coil spring 20 from the upper side, and holds the coil spring 20 and prevents the inclination thereof. The coil spring 20 is mounted in a compressed manner between the plug 17 and the support member 24. The valve chamber 15 is formed into a stepped shape having a step 26 conforming to an outline of the support member 24 in an upper inner wall connecting to the valve hole 32*a*, and the refrigerant can pass through a space formed between the inner wall of the valve chamber 15 and the support member 24.

Figure 2:
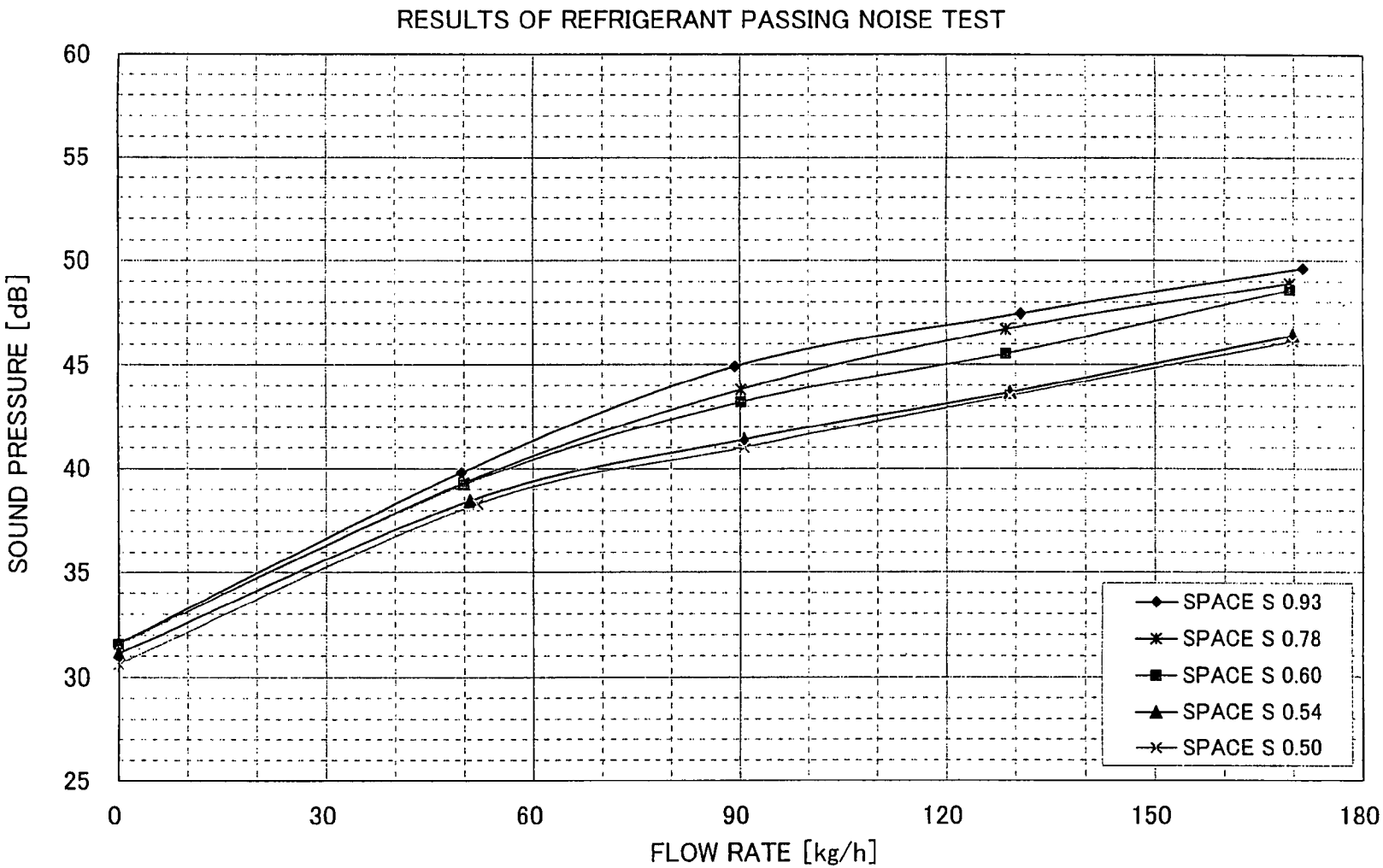
FIG. 2 is a graph showing results of a refrigerant passing noise test of the expansion valve.

The results of a refrigerant passing noise test of the expansion valve are shown in a graph in FIG. 2. FIG. 2 is a graph in which the axis of abscissa represents the flow rate (kg/h) and the axis of ordinate represents the sound pressure (dB) of refrigerant passing noise, and spaces S are plotted as parameters. The graph reveals that when the space S is 0.54 mm or smaller, the sound pressure is significantly reduced and the refrigerant passing noise is significantly reduced as compared with the cases with larger spaces.

The valve chamber 15 has an inner diameter slightly larger than an outer diameter of the coil spring 20, and the plug 17 has an inner diameter such that the spring support 17*a* houses the coil spring 20 without a radial space, thus the valve chamber 15 and the plug 17 can be formed to have as small a radial size as possible with respect to the coil spring 20. Also, since the O ring 19 is placed on the opposite side of the bottom end of the large diameter passage portion 13 in the inlet port 321, the plug 17 can be screwed into an upper position, and the space S of the coil spring 20 is small as described above and the plug 17 has the closed-end cylindrical spring support 17*a* that receives the lower end of the coil spring 20, thereby reducing a vertical size of the valve body 30. Further, the outer peripheral portion of the plug 17 has the diameter decreasing toward the upper end in the stepped shape, and the O ring 19 is placed in the annular space 18 formed between the upper end outer peripheral portion of the plug and the inner peripheral portion of the valve chamber 15, thereby also reducing a lateral size of the valve body 30. This can reduce the size, weight and cost of the expansion valve as a whole.

Figure 3:
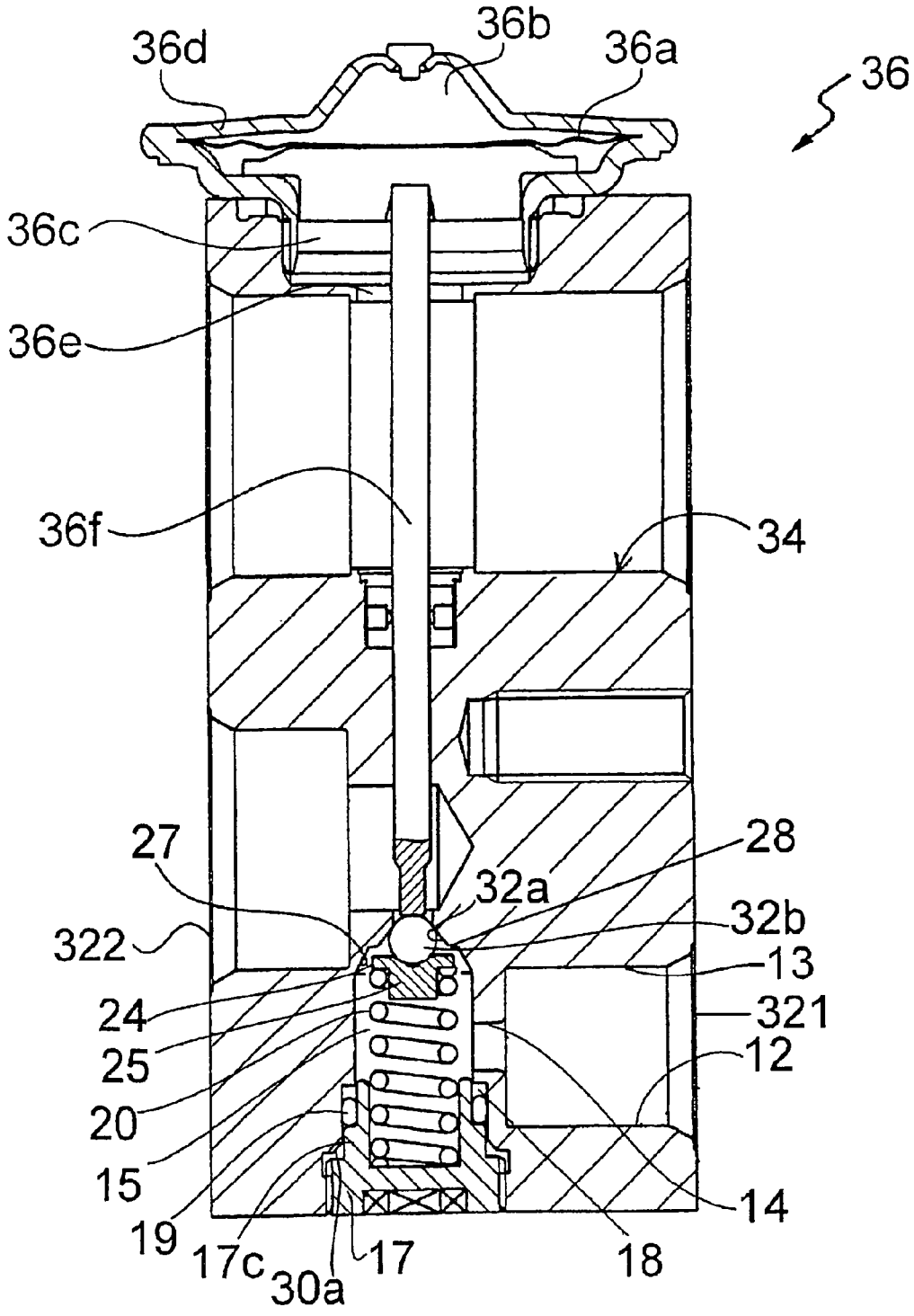
FIG. 3 shows another embodiment of an expansion valve according to the present invention.

FIG. 3 is a vertical sectional view of another embodiment of an expansion valve according to the present invention. In the expansion valve in FIG. 3, the same components and sites as those of the expansion valve in FIG. 1 are denoted by the same reference numerals, and repetitive descriptions thereof will be omitted. In the expansion valve in FIG. 1, the inner wall has the step 26 with a right-angled corner in the upper portion of the valve chamber 15, and bubbles in the passing refrigerant may collide with the step 26 to encourage the break of the bubbles and produce refrigerant passing noise.

In the expansion valve in FIG. 3, an upper inner wall of a valve chamber 15 is formed into an inclined surface 27 that is substantially tapered upward. The inclined surface 27 forms a slight step at a connection 28 with a valve hole 32*a*, but the step is not as large as that in FIG. 1 and does not significantly encourage the break of the bubbles, thereby more reliably reducing refrigerant passing noise.

What is claimed is:

1. An expansion valve with noise reduction means comprising:

a valve body;

an inlet port formed in the valve body and through which a high pressure liquid refrigerant is introduced;

a valve chamber communicating with the inlet port and having a lower end opening in a bottom surface of the valve body;

the inlet port including a large diameter passage portion formed from one side surface toward the other side surface of the valve body, and also including a small diameter passage portion that provides communication between the large diameter passage portion and the valve chamber, the large diameter passage portion including a bottom end at the lowest portion of the large diameter passage portion, and a vertical end face being defined by a surface between the large diameter passage portion and the small diameter passage portion;

a valve hole provided in the valve chamber;

an outlet port formed in the valve body and through which the refrigerant expanded in the valve hole is discharged to the outside;

a valve member that is brought close to and apart from a valve seat provided at an inlet of the valve hole and opens and closes the valve hole;

a coil spring provided in the valve chamber for biasing the valve member toward the valve hole;

a plug that is inserted and mounted into the lower end of the valve chamber to support a lower end of the coil spring, and closes the opening of the valve chamber, an outer peripheral portion of the plug having a stepped diameter decreasing toward an upper end;

an annular space formed in the valve chamber below the small diameter passage portion of the inlet port and extending from above the elevation of the bottom end of the large diameter passage portion; and an O ring located below and adjacent the small diameter passage portion and being above the bottom end and on the opposite side of the vertical end face of the large diameter passage portion, wherein the O ring is disposed in the annular space formed between the vertical end face of the large diameter passage portion and a side surface of the valve chamber.

2. The expansion valve with noise reduction means according to claim 1, wherein the plug has a closed-end cylindrical spring support that receives the lower end of the coil spring.

3. An expansion valve with noise reduction means comprising: an inlet port through which a high pressure liquid refrigerant is introduced; a valve chamber communicating with the inlet port; a valve hole provided in the valve chamber; an outlet port through which the refrigerant expanded in the valve hole is discharged to the outside;

a valve member that is brought close to and apart from a valve seat provided at an inlet of the valve hole and opens and closes the valve hole; a coil spring provided in the valve chamber for biasing the valve member toward the valve hole, wherein a size of a space between adjacent coil wires of the coil spring is set so as to reduce bubbles entrained in the liquid refrigerant to a finer size, and the size of the space in an expanding and contracting direction of the coil spring is 0.54 mm or smaller in a state where the valve member abuts against the valve seat; an annular space formed in the valve chamber below a small diameter passage portion of the inlet port and extending from above an elevation of a bottom end of a large diameter passage portion of the inlet port; and an O ring located below and adjacent the small diameter passage portion and being above the bottom end and on the opposite side of a vertical end face of the large diameter passage portion, wherein the O ring is disposed in the annular space formed between the vertical end face of the large diameter passage portion and a side surface of the valve chamber.

* * * * *